US006237568B1

(12) United States Patent
Askew et al.

(10) Patent No.: US 6,237,568 B1
(45) Date of Patent: May 29, 2001

(54) FUEL SYSTEM

(75) Inventors: James Martin Anderton Askew, Stroud; Alan George Wilson, Witney, both of (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/416,004

(22) Filed: Oct. 8, 1999

(30) Foreign Application Priority Data

Oct. 10, 1998 (GB) ..... 9822054

(51) Int. Cl.[7] ..... F02M 33/04
(52) U.S. Cl. ..... 123/446
(58) Field of Search ..... 123/510, 511, 123/446, 462; 251/310

(56) References Cited

U.S. PATENT DOCUMENTS 3,896,194 * 7/1975 Martin ..... 251/310
4,554,946 * 11/1985 Poole ..... 251/310

* cited by examiner

*Primary Examiner*—Thomas N. Moulis
(74) *Attorney, Agent, or Firm*—Andrus, Sceales, Starke & Sawall

(57) ABSTRACT

A fuel system for use with viscous fuels comprising a housing defining a supply passage through which fuel can flow, in use, from a source of viscous fuel towards a fuel pump, and a throttle member located within the housing and arranged to control the rate of fuel flow along the supply passage. The throttle member is angularly adjustable within the housing to adjust the permitted fuel flow rate between the source and the pump.

15 Claims, 1 Drawing Sheet

FUEL SYSTEM

This invention relates to a fuel system for use in supplying a fuel of the type which is viscous at relatively low temperatures to a combustion space of an associated internal combustion engine of the compression ignition type. The invention is particularly applicable to a fuel system of the common rail type.

Figure 1:
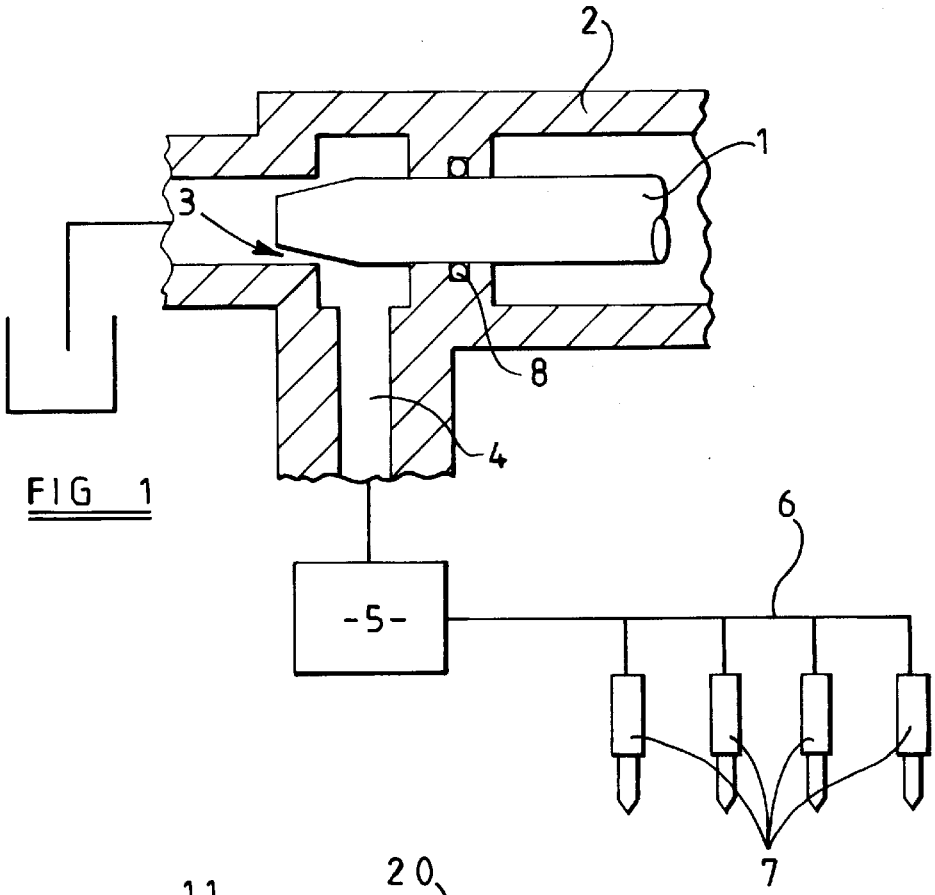

A typical common rail system for use with a viscous fuel is illustrated in FIG. 1 and comprises a fixed displacement fuel pump 5 arranged to charge a common rail 6 to a desired high pressure. A plurality of individually actuable fuel injectors 7 are connected to the common rail 6 to permit delivery of fuel from the common rail 6 to the combustion spaces of a compression ignition internal combustion engine. In order to control the fuel pressure within the common rail 6, the quantity of fuel supplied to the fuel pump 5 is controlled using a throttle to limit the rate at which fuel can flow to the pump 5. If desired, appropriate non-return valves may be used to prevent fuel flow through the pump 5 in the reverse direction.

The throttle illustrated in FIG. 1 comprises a throttle member 1 which is linearly displaceable within a housing 2 to vary the effective dimensions of an annular orifice 3, thus restricting the rate at which fuel can flow along a supply passage 4 towards the fuel pump 5. Movement of the throttle member 1 is conveniently controlled by an appropriate linear travel proportional solenoid. A seal member 8 forms a substantially fluid tight seal between the throttle member 1 and the housing 2.

In use, viscous fuel flows through the supply passage 4 around the exposed part of the throttle member 1. If it is desired to adjust the fuel flow rate to adjust the rate at which fuel is supplied by the pump 5 to the common rail 6 to which the fuel injectors 7 are connected, then the axial position of the throttle member 1 is adjusted. If the throttle member 1 is retracted by a small distance, a small quantity of fuel may be drawn with the throttle member 1 past eh seal member 8. These traces of fuel may dry out leaving deposits on the throttle member 1 which may cause wear, impair movement of the throttle member 1 and may cause further leakage to occur.

It is an object of the invention to provide a fuel system for use with viscous fuels in which the effects of this disadvantage are reduced.

According to the present invention there is provided a fuel system for use with viscous fuels comprising a housing defining a supply passage through which fuel can flow, in use, from a source of viscous fuel towards a fuel pump, and a throttle member located within the housing and arranged to control the rate of fuel flow along the supply passage, wherein the throttle member is angularly adjustable within the housing to adjust the permitted fuel flow rate.

The throttle member is conveniently arranged to be driven by a rotary travel type solenoid arrangement.

In such an arrangement, as the throttle member does not move in an axial direction, the risk of fuel being drawn past a seal member as a result of adjustment of the throttle is reduced, hence the risk of wear, impaired performance and additional leakage is reduced.

Figure 2:
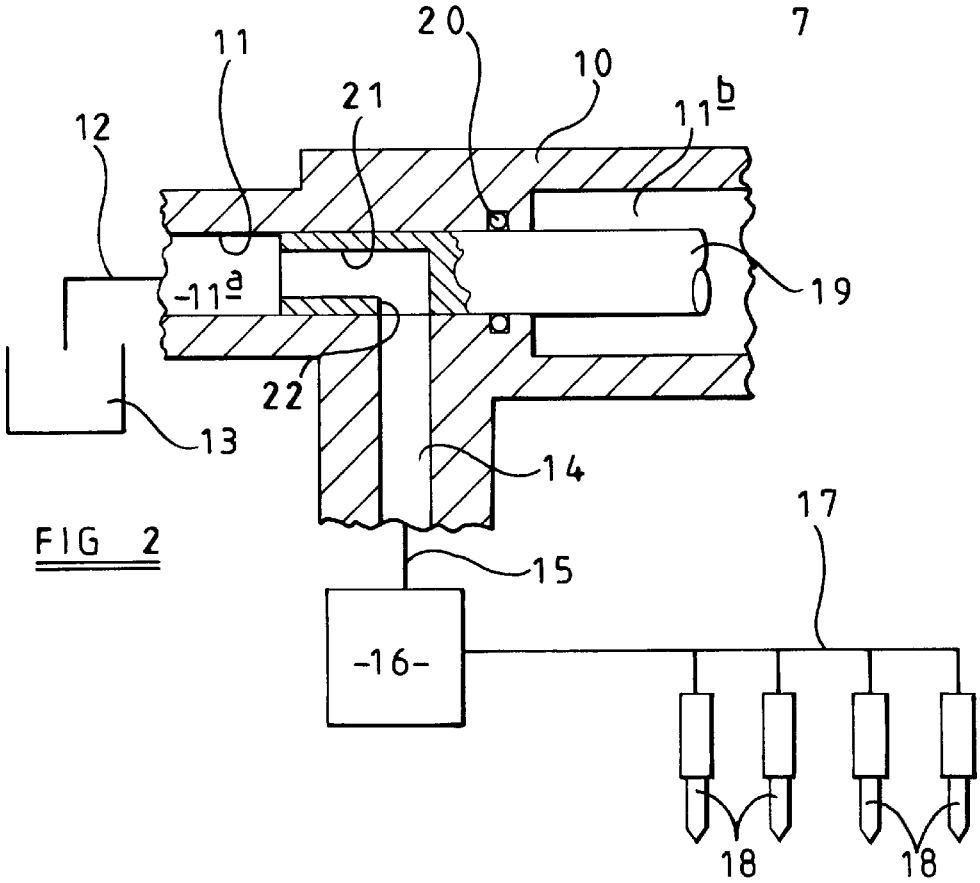

The invention will further be described, by way of example, with reference to the accompanying drawings, in which:

FIG. 1 is a diagrammatic view illustrating a typical fuel system for use with viscous fuels; and FIG. 2 is a view similar to FIG. 1 illustrating a fuel system in accordance with an embodiment of the invention.

The fuel system illustrated in FIG. 2 is intended for use with a heavy fuel of the type which is relatively viscous at low temperatures for example of the type used in certain marine applications. The fuel system comprises a housing 10 provided with a bore 11 of stepped form which communicates through an appropriate passage 12 with a fuel reservoir 13. The bore 11 communicates through a drilling 14 and a passage 15 which communicates with the drilling 14 with an appropriate fixed displacement pump which operates, in use, to charge a common rail 17 with fuel, the common rail 17 communicating with a plurality of individually actuable fuel injectors 18 whereby the fuel is supplied, at appropriate times, to the combustion spaces of an associated internal combustion engine.

A throttle member 19 is located within the bore 11, a seal member 20 being located around the throttle member 19 to form a substantially fluid tight seal between the throttle member 19 and the housing 10. The substantially fluid tight seal between the throttle member 19 and the housing 10 substantially prevents fuel flow along the bore 11, dividing the bore 11 into two chambers, a first chamber 11*a* which communicates with the fuel reservoir 13 and the drilling 14, and a second chamber 11*b* which is isolated from the fuel reservoir 13. The drilling 14 and the part of the bore 11 defining the first chamber 11*a* together define a supply passage whereby fuel is supplied, in use, from the fuel reservoir 13 to the fuel pump 16.

The part of the throttle member 19 located within the part of the bore 11 defining the first chamber 11*a* is provided with a blind bore 21 which communicates with a radially extending drilling 22 located so as to be registrable with the part of the drilling 14 which opens into the bore 11. The throttle member 19 is connected to the output shaft of a rotary travel type proportional solenoid actuator arrangement which is capable of adjusting the angular position of the throttle member 19 within the housing 10. Means (not shown) are provided to substantially prevent axial movement of the throttle member 19 relative to the housing 10.

The solenoid actuator arrangement is arranged to drive the throttle member 19 between a first angular position in which the radial drilling 22 is registered with the drilling 14, thus providing a relatively unrestricted flow path between the fuel reservoir 13 and the pump 16, and a second angular position in which the radial drilling 22 is completely out of register with the drilling 14, and thus fuel is unable to flow from the reservoir 13 to the fuel pump 16, the actuator being capable of holding the throttle member in a plurality of stable positions between the first and second positions. It will be appreciated, therefore, that by appropriate control of the solenoid actuator, the effective dimensions of the area through which fuel is able to flow defined by the area of overlap between the radial drilling 22 and the drilling 14 can be controlled.

As, in order to adjust the rate at which fuel is able to flow towards the fuel pump 16 through the supply passage, the axial position of the throttle member 19 is not adjusted, it will be appreciated that the throttle member 19 does not include regions which are alternately wetted by the fuel and then moved to the other side of the seal member 20. As a result, the risk of fuel drying out on the part of the throttle member 19 located within the second chamber 11*b* is reduced, and therefore the risk of increased wear, the risk of movement of the throttle member 19 being impaired, and the risk of additional leakage are reduced.

The second chamber 11*b* may be open to the atmosphere, or if desired, a second fluid, for example pressurized lubricating oil may be applied to the second chamber 11*b*.

In addition to the advantages set out hereinbefore, the arrangement of the present invention is advantageous in that the effects of the fuel pressure upon the solenoid actuator are independent of the setting of the throttle. In a linear travel arrangement, the load applied to the solenoid by the throttle member is likely to vary depending upon the axial position of the throttle member. In the angularly adjustable arrangement of the present invention, the effect of the fuel pressure upon the solenoid is substantially constant irrespective of the throttle setting.

If desired, the drilling 22 and/or the drilling 14 may be replaced by one or more passages of non-circular cross-sectional area to modify the manner in which the effective cross-sectional area through which fuel can flow changes for a given movement of the throttle member. For example, appropriately shaped passages may give rise to a throttle arrangement in which the response of the throttle to angular movement of the actuator is linear.

We claim:

1. A fuel system for use with viscous fuels comprising a housing defining a supply passage through which fuel can flow, in use, from a source of viscous fuel towards a fuel pump, and a throttle member located within said housing, the throttle member being arranged such that its axis extends substantially along the axis of the supply passage, so as to control the rate of fuel flow along said supply passage, wherein said throttle member is angularly adjustable about its axis within said housing to adjust the permitted fuel flow rate.

2. The fuel system as claimed in claim 1, wherein said throttle member is arranged to be driven by a rotary travel type solenoid arrangement.

3. The fuel system as claimed in claim 1, further comprising a seal member located around said throttle member to form a substantially fluid tight seal between said throttle member and said housing.

4. The fuel system as claimed in claim 1, wherein a part of said supply passage is defined by a bore provided in said housing, said throttle member being located within said bore.

5. The fuel system as claimed in claim 4, wherein said throttle member is provided with a drilling which communicates with said source, said drilling being registrable with a further drilling provided in said housing to control the rate of flow of fuel along said supply passage.

6. The fuel system as claimed in claim 5, wherein said throttle member is provided with a bore and a radially extending drilling, said radially extending drilling being registrable with said further drilling provided in said housing to control the rate of flow of fuel along said supply passage.

7. The fuel system as claimed in claim 6, wherein said radially extending drilling provided in said throttle member is of non-circular cross-section.

8. The fuel system as claimed in claim 6, wherein said further drilling provided in said housing is of non-circular cross-section.

9. A fuel system for use with viscous fuels comprising a housing defining a supply passage through which fuel can flow, in use, form a source of viscous fuel towards a fuel pump, and a throttle member located within said housing, wherein said throttle member is angularly adjustable within said housing to adjust the permitted fuel flow rate, a part of said supply passage being defined by a bore provided in said housing, wherein said throttle member is located within said bore and is provided with a drilling which communicates with said source, said drilling being registerable with a further drilling provided in said housing to control the rate of flow of fuel along said supply passage.

10. The fuel system as claimed in claim 9, wherein said throttle member is provided with a bore and a radially extending drilling, said radially extending drilling being registerable with said further drilling provided in said housing to control the rate of flow of fuel along said supply passage.

11. The fuel system as claimed in claim 10, wherein said radially extending drilling provided in said throttle member is of non-circular cross-section.

12. The fuel system as claimed in claim 10, wherein said further drilling provided in said housing is of non-circular cross-section.

13. The fuel system as claimed in claim 11, wherein said further drilling provided in said housing is of non-circular cross-section.

14. The fuel system as claimed in claim 9, wherein said throttle member is arranged to be driven by a rotary travel-type solenoid arrangement.

15. The fuel system as claimed in claim 9, further comprising a seal member located around said throttle member to form a substantially fluid tight seal between said throttle member and said housing.

* * * * *